US010122120B2

(12) United States Patent
Kato

(10) Patent No.: US 10,122,120 B2
(45) Date of Patent: Nov. 6, 2018

(54) LEVER TYPE CONNECTOR

(71) Applicant: Yazaki Corporation, Tokyo (JP)

(72) Inventor: Motofumi Kato, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/711,750

(22) Filed: Sep. 21, 2017

(65) Prior Publication Data

US 2018/0090882 A1 Mar. 29, 2018

(30) Foreign Application Priority Data

Sep. 27, 2016 (JP) ..... 2016-187773

(51) Int. Cl.
*H01R 13/62* (2006.01)
*H01R 13/629* (2006.01)
*H01R 107/00* (2006.01)

(52) U.S. Cl.
CPC . *H01R 13/62938* (2013.01); *H01R 13/62955* (2013.01); *H01R 2107/00* (2013.01)

(58) Field of Classification Search
CPC ..... H01R 13/62933; H01R 13/62938; H01R 13/62944; H01R 13/6295; H01R 13/62955; H01R 13/62961; H01R 13/62966; H01R 13/62972
USPC ..... 439/372
See application file for complete search history.

(56) References Cited

U.S. PATENT DOCUMENTS 6,928,097 B2 8/2005 Chida
7,628,639 B2 12/2009 Matsumura et al.
2017/0365953 A1* 12/2017 Sugimoto ..... H01R 13/62938

FOREIGN PATENT DOCUMENTS

JP 2009-152063 A 7/2009

* cited by examiner

*Primary Examiner* — Ross Gushi
(74) *Attorney, Agent, or Firm* — Sughrue Mion, PLLC

(57) ABSTRACT

A lever type connector includes a first housing having a hood part, a second housing fittable into the hood part, a lever swingably assembled to an outer circumference of the second housing in a manner that a swing motion of the lever allows the second housing to be fitted in the hood part and allows the lever to be accommodated in the hood part, and a backlash preventing part provided in the lever and formed so as to project toward an inner wall surface of the hood part. The backlash preventing part is in pressure contact with the inner wall surface of the hood part when the second housing is fitted into the hood part.

5 Claims, 11 Drawing Sheets

LEVER TYPE CONNECTOR

CROSS REFERENCE TO RELATED APPLICATION

The present application is based on, and claims priority from Japanese Patent Application No. 2016-187773, filed Sep. 27, 2016, the disclosure of which is hereby incorporated by reference herein in its entirety.

TECHNICAL FIELD

The present application relates to a lever type connector.

BACKGROUND ART

As a lever type connector in a conventional example, there is known a lever connector which includes a first housing having a hood part, a second housing fittable in the hood part of the first housing, and a lever which is swingably assembled to the outer circumference of the second housing so that its swinging motion allows the second housing to be fitted in the hood part and also allows the lever to be accommodated in the hood part (refer to U.S. Pat. No. 7,628,839 B2).

In the conventional lever type connector, by swinging the lever when fitting the second housing into the hood part of the first housing, it is possible to reduce a fitting force between the first housing and the second housing due to a lever action by a cam and the like provided between the first housing and the lever.

SUMMARY

In the conventional lever type connector, as the lever swingably assembled to the second housing is adapted so as to be accommodated in the hood part of the first housing, a gap for allowing a swing motion of the lever is required between the hood part of the first housing and the second housing.

Due to the presence of such a gap between the hood part of the first housing and the second housing, if an external force is applied to the first housing or the second housing in the fitting state of the first housing and the second housing, vibration is produced about the gap and then propagated to each other.

If such a propagation of vibration is generated, respective contacts of a plurality of terminals, which are accommodated in the first and second housings and which are to be connected with each other in the fitting state of the first housing and the second housing, are subjected to abrasion, thereby producing the possibility of increasing an electric resistance.

It is therefore an object of the present application to provide a lever type connector capable of preventing the propagation of vibration in the fitting state of the first housing and the second housing.

A lever type connector according to an aspect of the present application includes: a first housing having a hood part; a second housing to be fittable into the hood part; a lever swingably assembled to an outer circumference of the second housing in a manner that a swing motion of the lever allows the second housing to be fitted in the hood part and allows the lever to be accommodated in the hood part; and a backlash preventing part provided in the lever and formed so as to project toward an inner wall surface of the hood part. The backlash preventing part is configured so as to be in pressure contact with the inner wall surface of the hood part under a condition that the second housing is fitted into the hood part.

As the backlash preventing part projecting from the lever is in pressure contact with the inner wall surface of the hood part when the second housing is fitted into the hood part of the first housing, the backlash preventing part closely adheres to the gap for allowing the swinging motion of the lever, which is defined between the hood part and the second housing of the first housing.

Thus, since the first housing is fixed integrally with the second housing through the backlash preventing part in the state where the first housing and the second housing are fitted to each other, even if an external force is applied on the first housing or the second housing, there is no possibility of causing the propagation of vibration from one side to the other side because the first housing and the second housing vibrate integrally.

Therefore, it is possible to prevent the propagation of vibration in the fitting state of the first housing and the second housing, and also possible to prevent an occurrence of abrasion at contacts between a plurality of terminals which are mutually accommodated in the first housing and the second housing and also connected with each other, thereby suppressing the increasing of an electric resistance.

The lever type connector may further include a backlash stopper rib provided in the second housing and formed so as to project toward the inner wall surface of the hood part. In this case, the backlash stopper rib is in pressure contact with the inner wall surface of the hood part when the second housing is fitted into the hood part.

As the first backlash stopper rib projecting from the second housing is in pressure contact with the inner wall surface of the hood part of the first housing when the second housing is fitted into the hood part of the first housing, the gap between the first housing and the second housing can be directly filled up by the first backlash stopper rib and additionally, it is possible to prevent the propagation of vibration in the fitting state of the first housing and the second housing.

The backlash preventing part and the backlash stopper rib may be arranged so that their respective positions in relation to a side surface of the second housing are different from each other in a length direction of the second housing.

In this case, since the backlash preventing part and the first backlash stopper rib are arranged so that their respective positions in relation to the side surface of the second housing are different from each other in the length direction of the second housing, it is possible to fill in the gap between the first housing and the second housing in a broader area in the length direction of the second housing, so that the propagation of vibration in the fitting state of the first housing and the second housing can be prevented stably.

With the aspect of the present application, it is possible to provide a lever type connector capable of preventing the propagation of vibration in the fitting state of the first and second housings.

DESCRIPTION OF EMBODIMENTS

Figure 1:
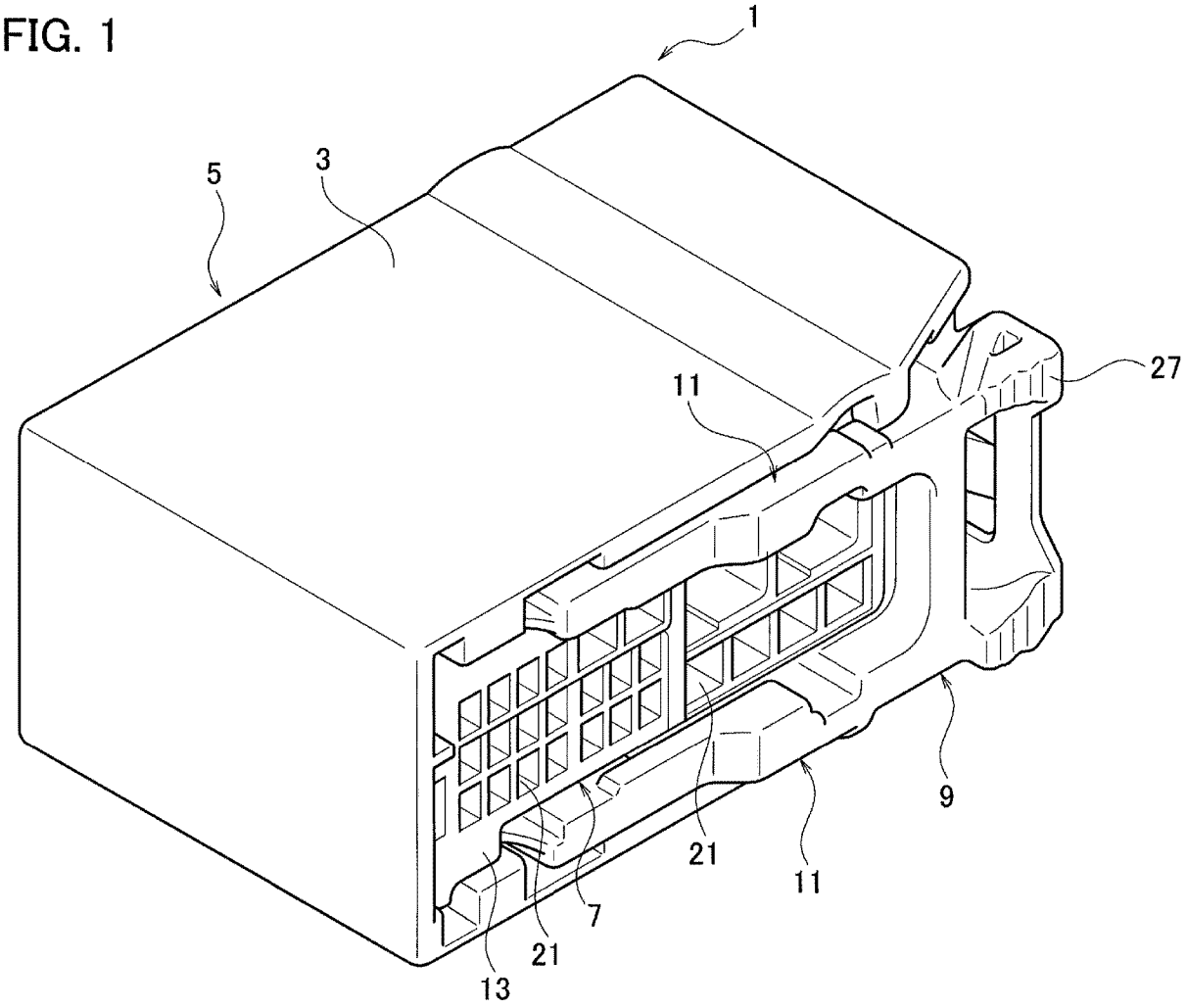
FIG. 1 is a perspective view of a lever type connector according to an embodiment.
Figure 2:
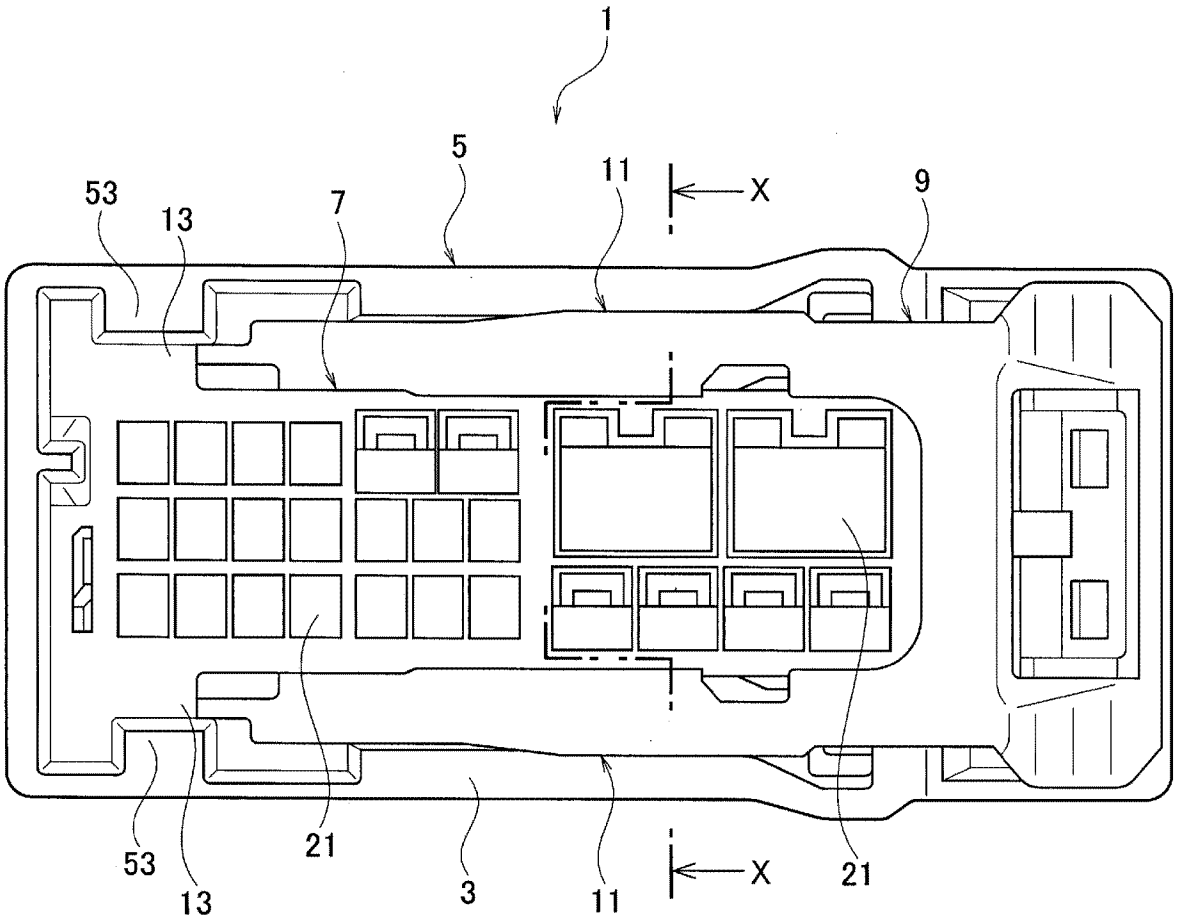
FIG. 2 is a front view of the lever type connector according to the embodiment.
Figure 3:
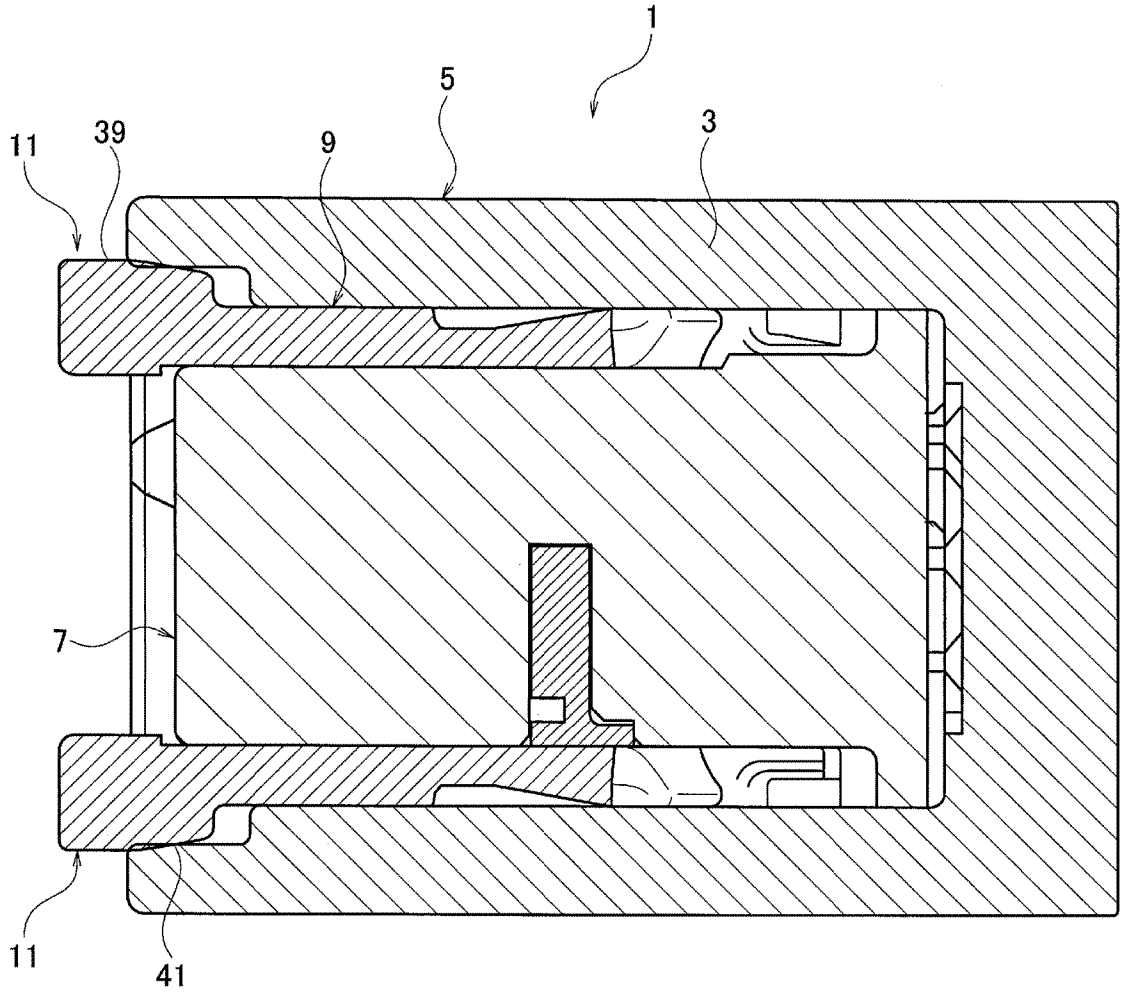
FIG. 3 is a cross sectional view taken along a line X-X of FIG. 2.
Figure 4:
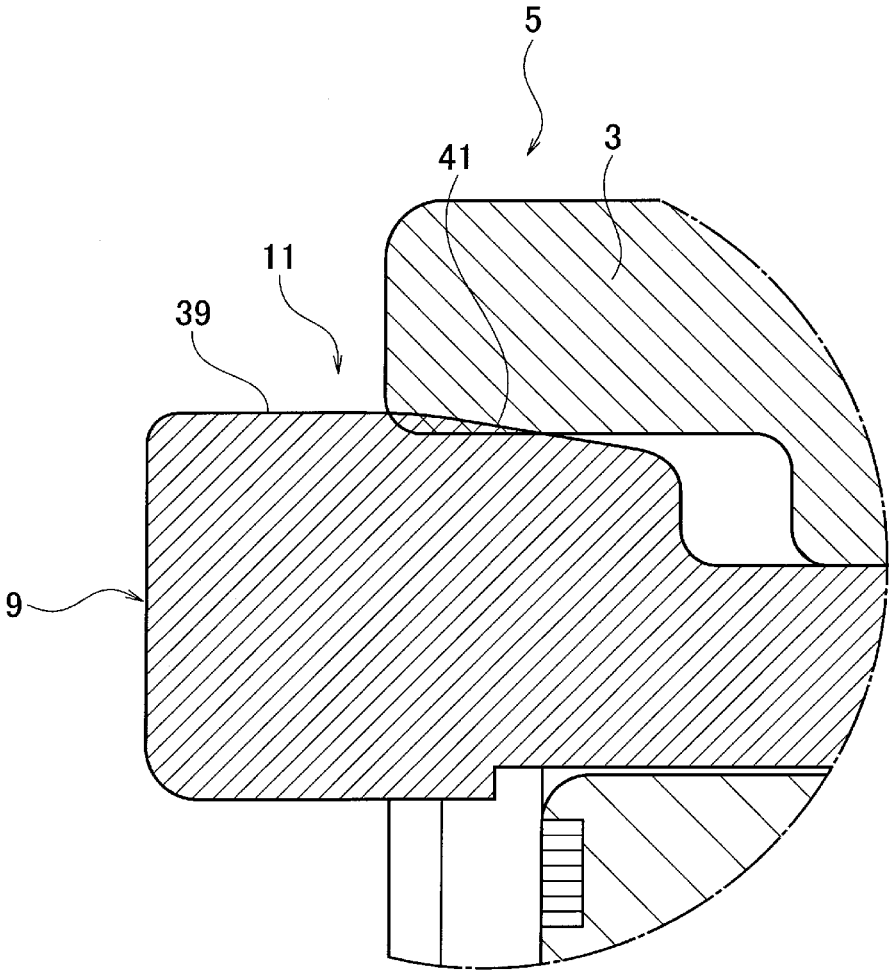
FIG. 4 is an enlarged view of an essential part of FIG. 3.

A lever type connector according to an embodiment will be described with reference to FIGS. 1 to 11.

The lever type connector 1 according to the embodiment includes a first housing 5 having a hood part 3, a second housing 7 fittable into the hood part 3, and a lever 9 which is swingably assembled to the outer circumference of the second housing 7 so that its swinging motion allows the second housing 7 to be fitted in the hood part 3 and also allows the lever 9 to be accommodated in the hood part 3.

The lever 9 is provided with backlash preventing parts 11 each projecting toward an inner wall surface of the hood part 3.

When the second housing 7 is fitted into the hood part 3, the backlash preventing parts 11 are brought into pressure contact with the inner wall surfaces of the hood part 3.

Meanwhile, the second housing 7 is provided with a pair of first backlash stopper ribs 13 each projecting toward the inner wall surface of the hood part 3.

When the second housing 7 is fitted into the hood part 3, the first backlash stopper ribs 13 are brought into pressure contact with the inner wall surfaces of the hood part 3.

The backlash preventing parts 11 and the first backlash stopper ribs 13 are arranged so that their positions in relation to the side surfaces of the second housing 7 are different from each other in the length direction of the second housing 7.

As illustrated in FIGS. 1 to 10, the first housing 5 is made of insulating material such as synthetic resin and includes the hood part 3 into which the second housing 7 can be fitted.

Figure 5:
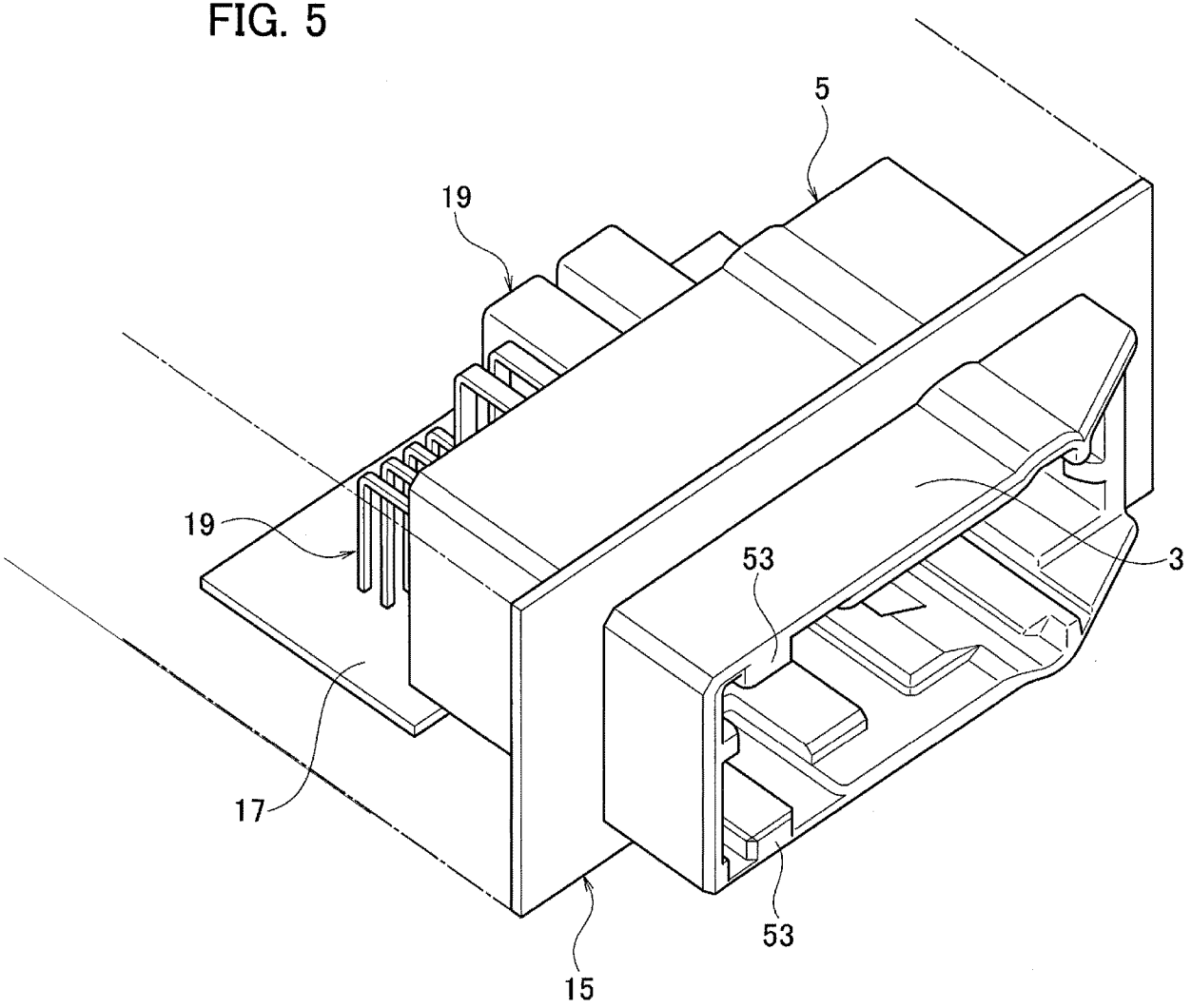
FIG. 5 is a perspective view of a first housing of the lever type connector according to the embodiment.

For instance, as illustrated in FIG. 5, the first housing 5 is arranged on a surface of a circuit substrate 17 accommodated in a casing member 15.

Respective one ends of first terminals 19 are electrically connected to conductors of the circuit substrate 17, while the other ends of the first terminals 19 are disposed in the hood part 3.

In the first housing 5, the hood part 3 is arranged in an opening formed in a wall part of the casing member 15. In such a state, the second housing 7 is fitted into the hood part 3.

Figure 6:
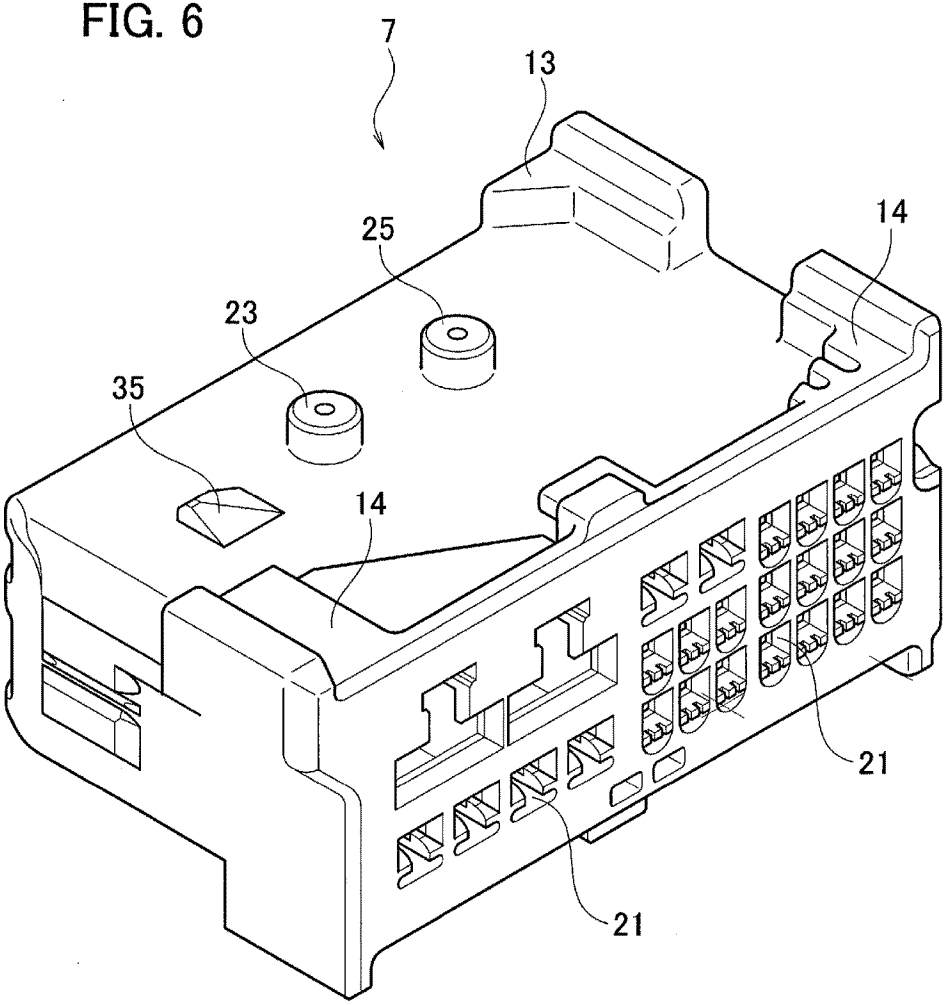
FIG. 6 is a perspective view of a second housing of the lever type connector according to the embodiment.
Figure 7:
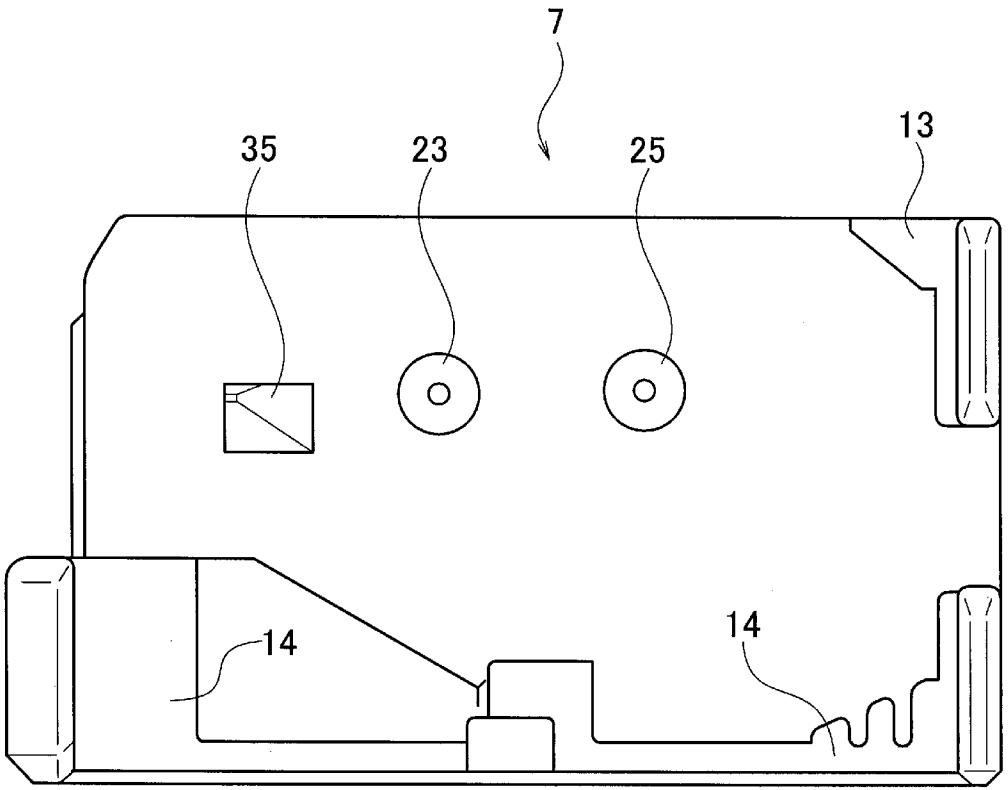
FIG. 7 is a side view of the second housing of the lever type connector according to the embodiment.

The second housing 7 is made of insulating material such as synthetic resin and also formed into a casing-like shape. As illustrated in FIG. 6, the second housing 7 is formed with a plurality of terminal accommodating chambers 21.

Accommodated in the terminal accommodating chambers 21 of the second housing 7 are, for example, a plurality of second terminals (not illustrated) which are respectively attached to respective end portions of a plurality of electric wires (not illustrated) connected to, for example, a power supply, an equipment, or the like.

When the second housing 7 is fitted into the hood part 3 of the first housing 5, the plurality of first terminals 19 accommodated in the first housing 5 are electrically connected to the plurality of second terminals (not illustrated) accommodated in the second housing 7.

The second housing 7 is provided, on its opposing side surfaces, with a pair of first rotating shafts 23 and a pair of second rotating shafts 25, each of which protrudes outward in a cylindrical shape. The lever 9 is swingably assembled to the second housing 7 through the first rotating shafts 23 and the second rotating shafts 25.

Figure 8:
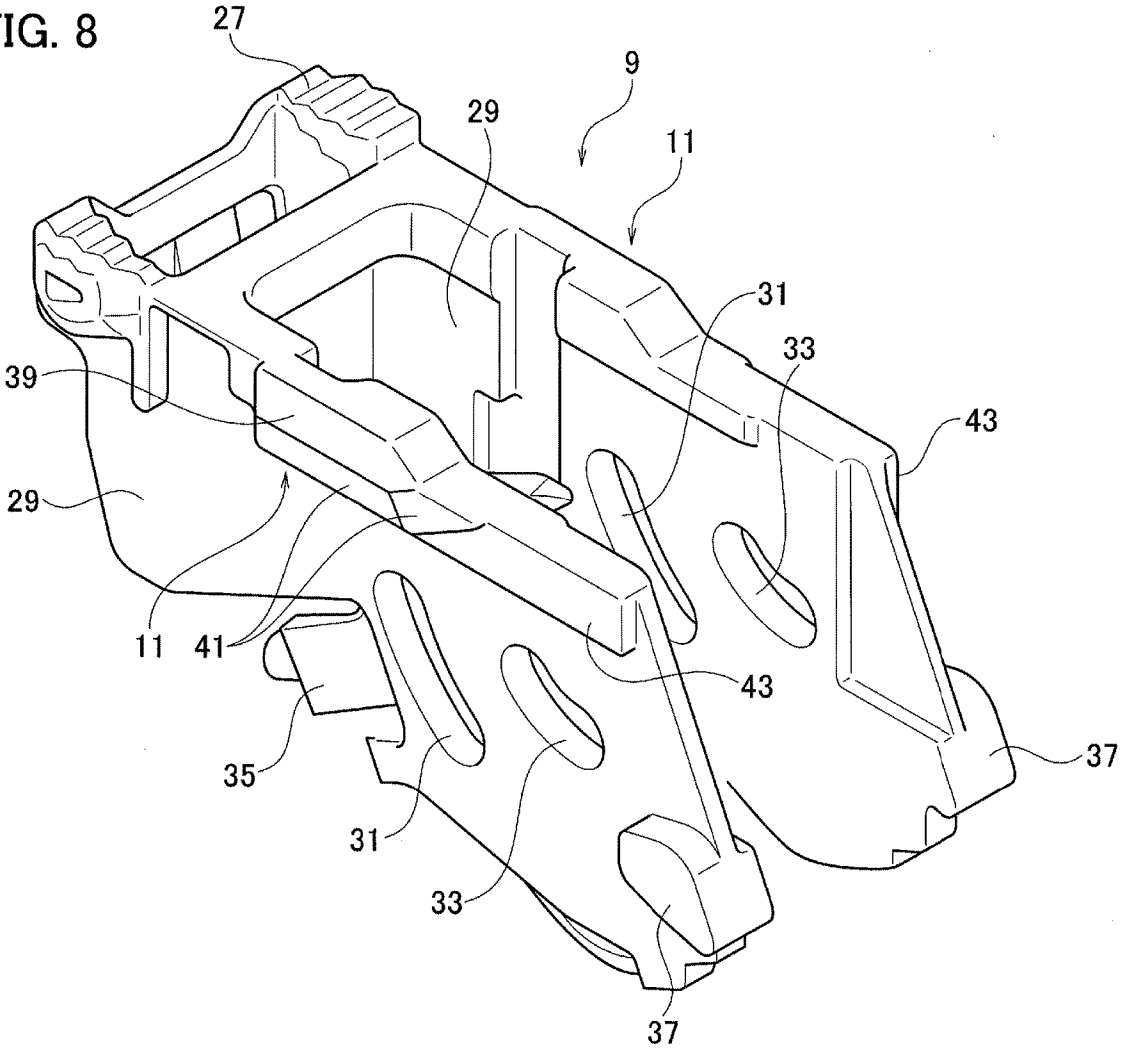
FIG. 8 is a perspective view of a lever of the lever type connector according to the embodiment.

The lever 9 is made of insulating material such as synthetic resin. As illustrated in FIG. 8, the lever 9 includes an operating part 27 extending in the width direction of the second housing 7, and a pair of side plate parts 29 which are connected to both ends of the operating part 27 and disposed on the pair of side surfaces of the second housing 7, respectively. The lever 7 is U-shaped by the operating part 27 and the side plate parts 29.

Through the operating part 27, an operator can swing the lever 9 in relation to the second housing 7.

As illustrated FIG. 8, the pair of side plate parts 29 have, at positions corresponding to the first rotating shafts 23 and the second rotating shafts 25 both projecting from the side surfaces of the second housing 7, a pair of first sliding grooves 31 in the form of elongated holes into which the first rotating shafts 23 are inserted respectively and a pair of second sliding grooves 33 in the form of elongated holes into which the second rotating shafts 25 are inserted respectively. The first sliding grooves 31 and the second grooves 33 are formed so as to penetrate the side plate parts 29 in each plate thickness direction.

Figure 9:
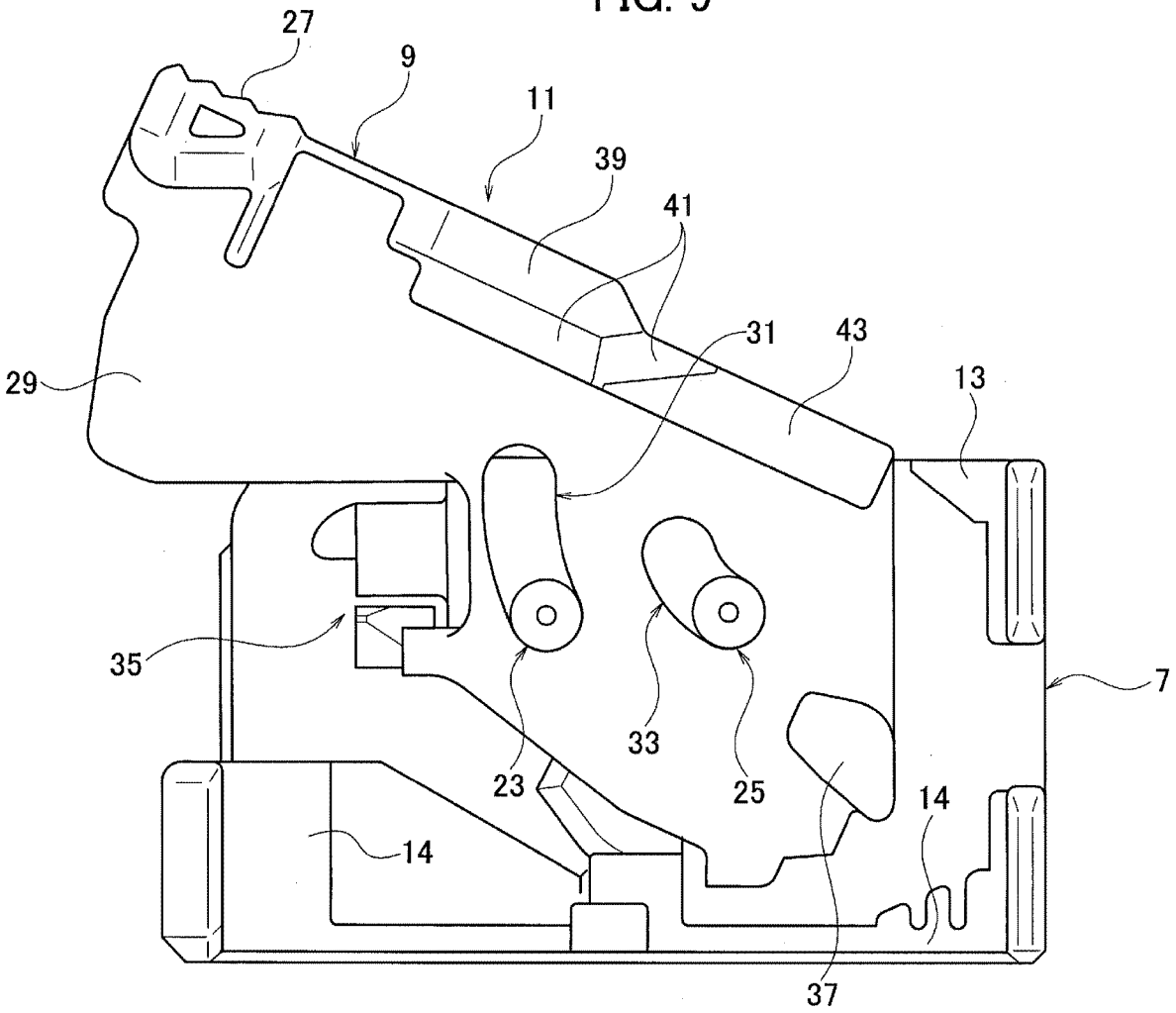
FIG. 9 is a side view of an arrangement where the lever is assembled to the second housing of the lever type connector according to the embodiment, at an initial (temporary locking) position.

As illustrated in FIG. 9, each of the first rotating shafts 23 is inserted into corresponding first sliding groove 31 and also engaged with one end side of the corresponding first sliding groove 31, and each of the second rotating shafts 25 is inserted into corresponding second sliding groove 33 and also engaged with one end side of the corresponding second sliding groove 33. As a result, the lever 9 is assembled to the second housing 7 swingably to the second housing 7.

As illustrated in FIGS. 6 and 8, the second housing 7 and the lever 9 are respectively provided with temporary locking parts 35 that can be engaged with each other. When the temporary locking parts 35 of the second housing 7 and the lever 9 are engaged with each other, an initial (temporary locking) position of the lever 9 in relation to the second housing 7 as illustrated in FIG. 9 is maintained under condition that the second housing 7 and the first housing 5 have not been fitted to each other.

Figure 10:
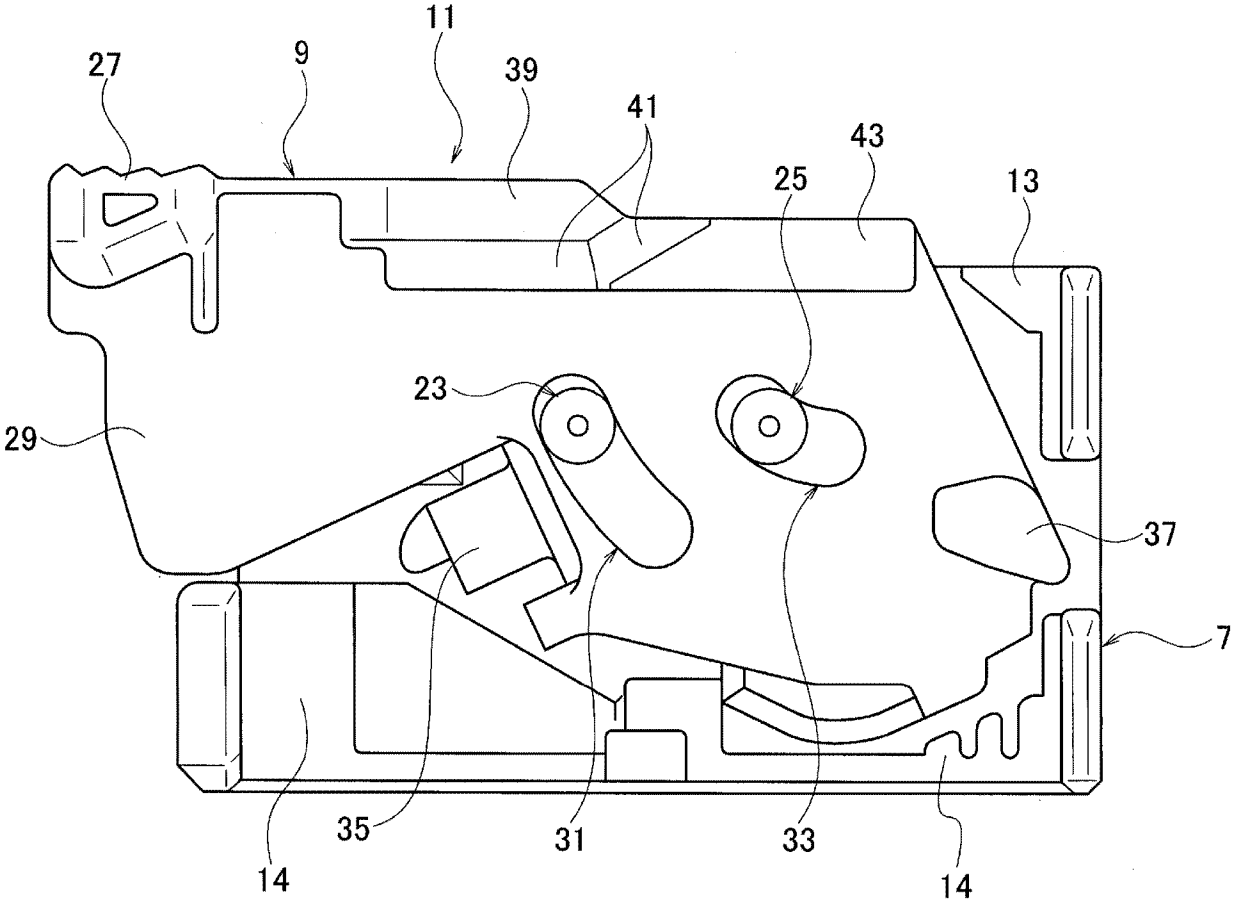
FIG. 10 is a side view of an arrangement where the lever is swung to a fitting position with respect to the second housing of the lever type connector according to the embodiment.

The lever 9 positioned at the initial position as illustrated in FIG. 9 is adapted so as to be swingable up to a fitting position where the fitting operation between the second housing 7 and the first housing 5 is completed as illustrated in FIG. 10.

The first rotating shafts 23 are disposed in the first sliding grooves 31 so that when the lever 9 swings from the initial position up to the fitting position, each of the first rotating shafts 23 moves from the one end side to the other end side of corresponding first sliding groove 31 along the corresponding first sliding groove 31. Similarly, the second rotating shafts 25 are disposed in the second sliding grooves 33 so that when the lever 9 swings in the above way, each of the second rotating shafts 25 moves from the one end side to the other end side of corresponding second sliding groove 33 along the corresponding second sliding groove 33.

The lever 9 is also provided, on its external surfaces of the slide plate parts 29, with fulcrum projections 37 which are engageable with fulcrum engaging parts (not illustrated) provided in the hood part 3 of the first housing 5, respectively.

When the second housing 7 and the first housing 5 are fitted to each other, the second housing 7 is inserted into the hood part 3 and successively, the fulcrum projections 37 are engaged with the fulcrum engaging parts in the hood part 3. In this state, the lever 9 is swung in relation to the second housing 7, from the initial position toward the fitting position.

With a swing motion of the lever 9, the first sliding grooves 31 press against and slide on the first rotating shafts 23, while the second sliding grooves 33 press against and slide on the second rotary shafts 25 about the engaging parts between the fulcrum projections 37 and the fulcrum engaging parts (not illustrated) as fulcrums. As a result, the second housing 7 is fitted to the first housing 5 so as to be pushed in, and the first terminals 19 accommodated in the first housing 5 are electrically connected to the second terminals (not illustrated) accommodated in the second housings 7.

Both the second rotating shafts 25 and the second sliding grooves 33 are components that mainly contribute to the fitting between the first housing 5 and the second housing 7, while both the first rotating shafts 23 and the first rotating shafts 23 are components that control engagement loci of the second rotating shafts 25 and the second sliding grooves 33, namely, a swing locus of the lever 9.

The first rotating shafts 23 and the first sliding grooves 31 for controlling the swing locus of the lever 9 contribute to the fitting between the first housing 5 and the second housing 7 supplementarily, thereby dispersing the fitting force applied on the second rotating shafts 25 so as to avoid breakage of the second rotating shafts 25.

By fitting the first housing 5 to the second housing 7 due to the swinging motion of the lever 9, it is possible to reduce the fitting force between the first housing 5 and the second housing 7, thereby allowing the fitting workability to be improved.

In the lever type connector 1 according to the embodiment, the second housing 7 having the lever 9 swingably assembled to its outer circumference is accommodated in the hood part 3 of the first housing 5, together with the lever 9.

For this reason, a gap for allowing the swing motion of the lever 9 is ensured in the hood part 3. Consequently, there is a possibility of producing backlash between the first housing 5 and the second housing 7 under the condition that they are fitted to each other.

Therefore, in order to prevent backlash from being produced among the first housing 5, the second housing 7, and the lever 9, the lever 9 is provided with the pair of backlash preventing parts 11, while the second housing 7 is provided with the pair of first backlash stopper ribs 13.

The pair of backlash preventing parts 11 are formed so as to project from the external surfaces of the side plate parts 29 of the lever 9 toward the inner wall surfaces of the hood part 3 of the first housing 5. Each of the backlash preventing parts 11 includes an abutment part 39 and a pressure contact part 41.

Each abutting part 39 forms a distal end surface in the projecting direction from the external surface of each of the side plate parts 29 and is disposed in parallel to the external surface of each of the side plate parts 29.

Each abutting part 39 abuts against an opening edge of the hood part 3 under condition that the lever 9 is swung to the fitting position in relation to the second housing 7 and also accommodated in the hood part 3 of the first housing 5.

Each pressure contact part 41 includes an inclined surface which is continuous to the contact part 39 and also inclined downward toward the swinging direction of the lever 9.

When the lever 9 is swung to the fitting position in relation to the second housing 7 to be accommodated in the hood part 3 of the first housing 5, the pressure contact parts 41 slide on the inner wall surfaces of the hood part 3 in such a way to press them.

Under condition that the lever 9 is swung to the fitting position in relation to the second housing 7 and then accommodated in the hood part 3 of the first housing 5, the pressure contact parts 41 are in pressure contact with the inner wall surfaces of the hood part 3.

By pressing each of the pressure contact parts 41 against the inner wall surface of the hood part 3, the gap for allowing the swing motion of the lever 9 in the hood part 3 is filled up by the pressure contact part 41, so that it is possible to prevent the occurrence of backlash among the first housing 5, the second housing 7, and the lever 7 in the fitting state of the first housing 5 and the second housing 7.

The backlash preventing parts 11 are in pressure contact with the inner wall surfaces of the hood part 3. Thus, in order to enhance the rigidity of the side plate parts 29 of the lever 9, each of the backlash preventing parts 11 is positioned on an external surface of each of reinforcing ribs 43 provided on the external surface of each of the side plate parts 29.

Figure 11:
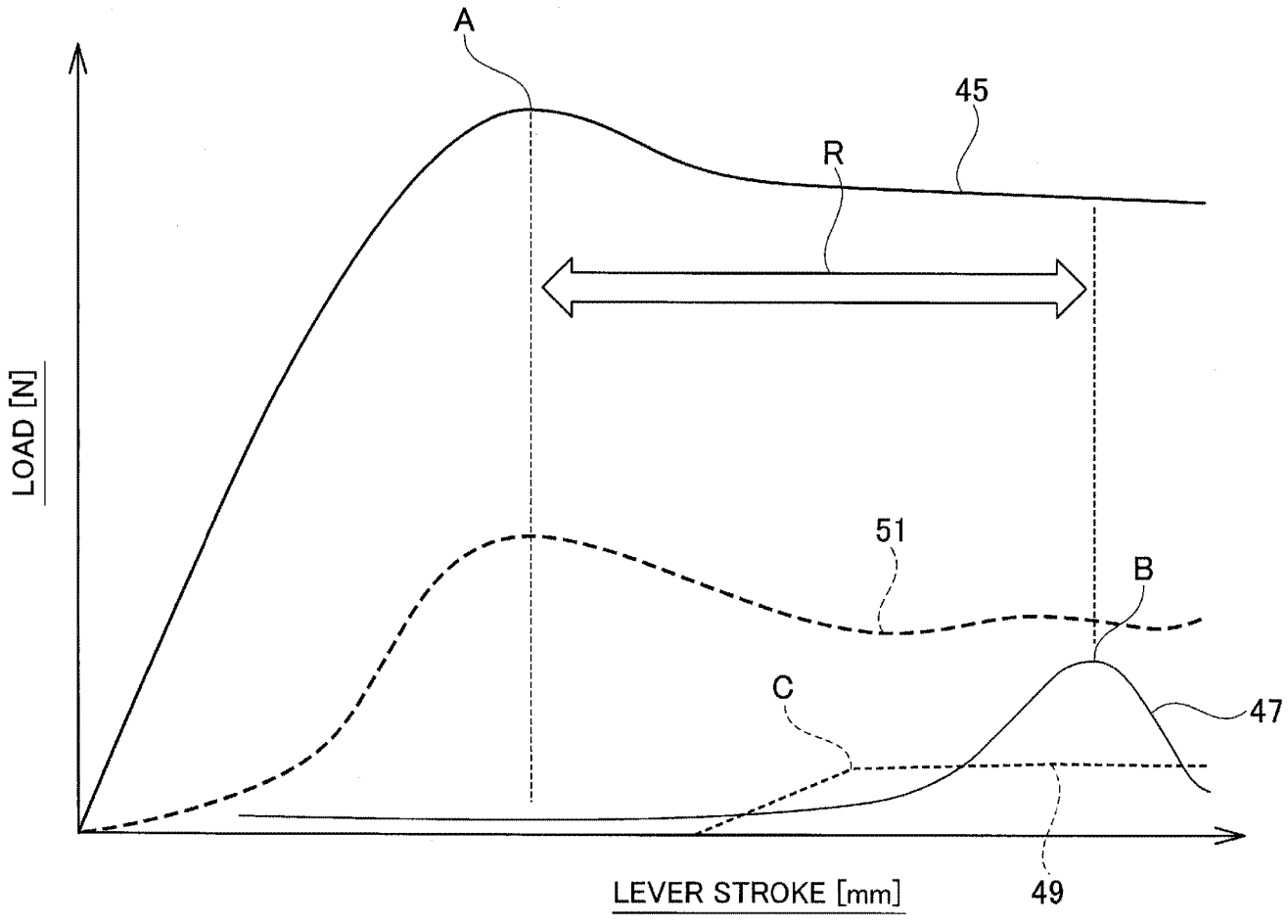
FIG. 11 is a diagram illustrating load changes in respective parts of the lever with respect to its swinging stroke, of the lever type connector according to the embodiment.

FIG. 11 is a diagram illustrating the change of a load applied on the lever 9 during the swinging stroke from the initial position up to the fitting position. In FIG. 11, a curve 45 illustrates the change of an inserting force of the first terminal 19 and the second terminal (not illustrated) in the above swinging stroke, and "A" designates a peak of the inserting force. Meanwhile, a curve 47 illustrates the change of an operating force when locking the lever 9 in the hood part 3, and "B" designates a peak of the operating force. Still further, a curve 49 illustrates the change of an inserting force while the backlash preventing parts 11 are being in pressure contact with the inner wall surface of the hood part 3, and "C" designates a peak of the inserting force. A shape of each of the backlash preventing parts 11 is set so that the peak "C" of the curve 49 is present within a range R between the peak "A" of the curve 45 and the peak "B" of the curve 47, as illustrated in FIG. 11.

By setting the shape of each of the backlash preventing parts 11 in this way, even if the lever 9 is provided with the backlash preventing parts 11 which are pressed against the inner wall surfaces of the hood part 3, it is possible to suppress the increasing of the operating force on the lever 9, as illustrated with a curve 51 that designates the change of the operating force on the lever 9.

The pair of first backlash stopper ribs 13 are formed so as to project from the pair of side surfaces of the second housing 7 toward the inner wall surfaces of the hood part 3 of the first housing 5.

When fitting the second housing 7 into the hood part 3, the first backlash stopper ribs 13 are put in contact with pressure-contacted parts 53 of the hood part 3. Here, the pressure-contacted parts 53 are formed so as to project from the inner wall surfaces of the hood part 3 toward the second housing 7. When the second housing 7 is fitted into the hood part 3 completely, the first backlash stopper ribs 13 are in pressure contact with the pressure-contacted parts 53, respectively.

Owing to the provision of the first backlash stopper ribs 13 on the second housing 7, the gaps between the first housing 5 and the second housing 7 can be directly filled up by the first backlash stopper ribs 13 and additionally, it is possible to prevent backlash between the first housing 5 and the second housing 7 stably.

The position of each of the first backlash stopper ribs 13 in relation the side surface of the second housing 7 is different from that of each of the backlash preventing parts 11 in the length direction of the second housing 7.

With the above-mentioned arrangement of the backlash preventing parts 11 and the first backlash stopper ribs 13, the backlash prevention can be accomplished at two positions on one side surface of the second housing 7 (i.e. four positions on both side surfaces) in the length direction of the second housing 7 and therefore, it is possible to prevent backlash between the first housing 5 and the second housing 7 more stably.

On the pair of side surfaces of the second housing 7, a pair of second backlash stopper ribs 14 is formed so as to project toward the inner wall surfaces of the hood part 3 of the first housing 5.

On the side faces of the second housing 7, the first backlash stopper ribs 13 are positioned on the opening side of the hood part 3 of the first housing 5, whereas the second backlash preventing ribs 14 are positioned on the bottom side of the hood part 3 of the first housing 5, in other words, the "front" side in the fitting direction.

Similarly to the first backlash stopper ribs 13, the second backlash stopper ribs 14 are also in pressure contact with the inner wall surfaces of the hood part 3 when the second housing 7 is fitted into the hood part 3.

Owing to the provision of the first backlash stopper ribs 13 and the second backlash stopper ribs 14 on both sides in the fitting direction of the second housing 7, the backlash prevention can be accomplished in a broader area of the second housing 7 and additionally, it is possible to prevent backlash between the first housing 5 and the second housing 7 more stably.

In the lever type connector 1 according to the embodiment, when the second housing 7 is fitted into the hood part 3 of the first housing 5, the backlash preventing parts 11 projecting from the lever 9 are in pressure contact with the inner wall surfaces of the hood part 3 of the first housing 5. Therefore, under the condition that the first housing 5 and the second housing 7 are fitted to each other, the backlash preventing parts 11 closely adhere to the gaps for allowing the swinging motion of the lever 9, which are defined between the hood part 3 of the first housing 5 and the second housing 7.

Thus, since the first housing 5 is fixed integrally with the second housing 7 through the backlash preventing parts 11 in the state where the first housing 5 and the second housing 7 are fitted to each other, even if an external force is applied on the first housing 5 or the second housing 7, there is no possibility of causing the propagation of vibration from one side to the other side because the first housing 5 and the second housing 7 vibrate integrally.

Therefore, in the lever type connector 1 according to the embodiment, it is possible to prevent the propagation of vibration in the fitting state of the first housing 5 and the second housing 7 and also possible to prevent an occurrence of abrasion at contacts between the plurality of terminals which are mutually accommodated in the first housing 5 and the second housing 7 and also connected with each other, thereby suppressing the increasing of an electric resistance.

The first backlash stopper ribs 13 projecting from the second housing 7 are in pressure contact with the inner wall surfaces of the hood part 3 of the first housing 5 when the second housing 7 is fitted into the hood part 3 of the first housing 5. Therefore, the gaps between the first housing 5 and the second housing 7 can be directly filled up by the first backlash stopper ribs 13 and additionally, it is possible to prevent the propagation of vibration in the fitting state of the first housing 5 and the second housing 7.

Further, the backlash preventing parts 11 and the first backlash stopper ribs 13 are arranged so as to be different from each other in terms of their positions in relation the side surface of the second housing 7 in the length direction of the second housing 7. Thus, it is possible to fill in the gaps between the first housing 5 and the second housing 7 in a broader area in the length direction of the second housing 7, so that the propagation of vibration in the fitting state of the first housing 5 and the second housing 7 can be prevented stably.

Although the lever type connector 1 according to the embodiment is provided with the first backlash stopper ribs 13 at two places on the outer circumference of the second housing 7, the present application is not limited to this, and three or more first backlash stopper ribs 13 may be provided on the outer circumference of the second housing 7 so long as they do not obstruct the swing motion of the lever 9.

What is claimed is:

1. A lever type connector, comprising:

a first housing having a hood part;

a second housing fittable into the hood part;

a lever swingably assembled to an outer circumference of the second housing in a manner that a swing motion of the lever allows the second housing to be fitted in the hood part and allows the lever to be accommodated in the hood part; and a backlash preventing part provided in the lever and formed so as to project toward an inner wall surface of the hood part, wherein the backlash preventing part is configured so as to be in pressure contact with the inner wall surface of the hood part under a condition that the second housing is fitted into the hood part, and the backlash preventing part includes an inclined surface, the inclined surface being inclined downward towards a swing direction of the lever and configured so as to be in pressure contact with the inner wall surface of the hood part under the condition that the second housing is fitted into the hood part.

2. The lever type connector of claim 1, wherein the inclined surface of the backlash preventing part is configured so as to be in pressure contact with a section of the inner wall surface of the hood part, that has a normal vector that is parallel to an axis of rotation of the lever, under the condition that the second housing is fitted into the hood part.

3. A lever type connector comprising:

a first housing having a hood part;

a second housing fittable into the hood part;

a lever swingably assembled to an outer circumference of the second housing in a manner that a swing motion of the lever allows the second housing to be fitted in the hood part and allows the lever to be accommodated in the hood part;

a backlash preventing part provided in the lever and formed so as to project toward an inner wall surface of the hood part; and a backlash stopper rib provided in the second housing and formed so as to project toward the inner wall surface of the hood part, wherein the backlash preventing part is configured so as to be in pressure contact with the inner wall surface of the hood part under a condition that the second housing is fitted into the hood part, and the backlash stopper rib is configured so as to be in pressure contact with the inner wall surface of the hood part under the condition that the second housing is fitted into the hood part.

4. The lever type connector of claim 3, wherein the backlash preventing part and the backlash stopper rib are arranged so that their respective positions in relation to a side surface of the second housing are different from each other in a length direction of the second housing.

5. The lever type connector of claim 3, further comprising:

an additional backlash stopper rib provided in the second housing and formed so as to project toward the inner wall surface of the hood part, wherein the additional backlash stopper rib is configured so as to be in pressure contact with the inner wall surface of the hood part under the condition that the second housing is fitted into the hood part, and under the condition that the second housing is fitted into the hood part, the backlash stopper rib is positioned at an opening side of the hood part and the additional backlash stopper rib is positioned at a bottom side of the hood part, the bottom side being a front side of the hood part in a fitting direction of the second housing into the hood part.

* * * * *